US008127492B1

(12) United States Patent
Hellman, Sr. et al.

(10) Patent No.: US 8,127,492 B1
(45) Date of Patent: Mar. 6, 2012

(54) COMPOUND BARRIER MECHANISM FOR PASSAGEWAY CONTROL

(76) Inventors: Robert R. Hellman, Sr., Oxford, CT (US); Robert R. Hellman, Jr., Oxford, CT (US)

( * ) Notice: Subject to any disclaimer, the term of this patent is extended or adjusted under 35 U.S.C. 154(b) by 310 days.

(21) Appl. No.: 12/653,053

(22) Filed: Dec. 8, 2009

Related U.S. Application Data

(63) Continuation-in-part of application No. 11/600,626, filed on Nov. 16, 2006, now abandoned.

(60) Provisional application No. 60/737,211, filed on Nov. 16, 2005.

(51) Int. Cl.
*E01F 13/00* (2006.01)

(52) U.S. Cl. ..... 49/49

(58) Field of Classification Search ..... 49/35, 49, 49/246, 247, 248, 249, 258
See application file for complete search history.

(56) References Cited

U.S. PATENT DOCUMENTS

| | | | | |
|---|---|---|---|---|
| 3,079,711 | A * | 3/1963 | Turner | 49/49 |
| 3,169,329 | A * | 2/1965 | Powers | 49/35 |
| 3,742,647 | A * | 7/1973 | Tomita | 49/35 |
| 4,290,230 | A * | 9/1981 | t'Kint de Roodenbeke | 49/49 |
| 4,472,908 | A * | 9/1984 | Wanzl et al. | 49/25 |
| 5,212,909 | A * | 5/1993 | Morin | 49/49 |
| 5,845,692 | A * | 12/1998 | Kellem et al. | 160/118 |
| 6,185,867 | B1 * | 2/2001 | McGuire | 49/109 |
| 7,845,115 | B2 * | 12/2010 | Ponert et al. | 49/47 |
| 2007/0271846 | A1 * | 11/2007 | Miller et al. | 49/49 |

FOREIGN PATENT DOCUMENTS

| | | | |
|---|---|---|---|
| GB | 2047328 | A * | 11/1980 |
| JP | 04306388 | A * | 10/1992 |

* cited by examiner

*Primary Examiner* — Jerry Redman
(74) *Attorney, Agent, or Firm* — K. Gibner Lehmann

(57) ABSTRACT

A barrier mechanism for providing selective access to a passageway on the floor of a lobby, room or pavilion. It utilizes a frame and carriage assembly thereon, a panel which is swivelable to selectively overlie and block the passageway, and an electric motor which powers the carriage assembly and moves the panel. A group of power components, including a driver operated by the motor and other linkages on the frame, provide simultaneous translating movement of the carriage assembly and panel and swiveling of the panel, synchronized to bring about a "wrap-around" effect to the latter. Optionally, the panel can be locked in either its blocking or its access position. Important safety features are incorporated in the mechanism, to prevent inadvertent injury to passageway personnel.

14 Claims, 16 Drawing Sheets

COMPOUND BARRIER MECHANISM FOR PASSAGEWAY CONTROL

CROSS-REFERENCES TO RELATED APPLICATIONS

The present application claims the benefit of the filing date of U.S. Provisional Application No. 60/737,211 filed Nov. 16, 2005, and titled COMPOUND BARRIER MECHANISM FOR PASSAGEWAY CONTROL AND METHOD OF USE, now abandoned.

The present application is a continuation-in-part of our Utility application, U.S. Ser. No. 11/600,626 filed Nov. 16, 2006 now abandoned, and entitled COMPOUND BARRIER MECHANISM FOR PASSAGEWAY CONTROL, now abandoned.

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

The present invention relates to barrier mechanisms generally and, more particularly, but not by way of limitation, to novel compound barrier mechanisms for passageway control.

2. Background Art

Pedestrian control devices generally fall into categories such as rotating arm turnstile, a dropping arm, a rotating gate, a pocket panel, an open passageway with optical detectors, and others.

In the category of control devices with barriers such as glass panels, there are three primary types in common use.

The first type typically employs an opposed pair of opposed wedge-shaped "leaves", their horizontal pivot axis falling towards the bottom of an enclosure. The leaves move in a single plane which is 90 degrees to the direction of passage. Disadvantages include an open wedge-shaped area below the leaves, of sufficient size such that when attempts are made to block larger passageways, the space left below is large enough to crawl through. Another disadvantage is that the rotating leaf is difficult to support and therefore easy to deflect in the direction of passage, typically resulting in its damage. Significantly, the rotating leaf unit is inefficient in its use of space in that the cabinet into which the leaf rotates must be at least as deep as the width of the leaf. Specifically, the overall width of a unit which supports two opposed leaves capable of blocking and clearing a 3'-0" ADA passageway, is in excess of 6'-0" in width inherently. Lastly, if a pedestrian inadvertently contacts the leaves as they are nearly closed, the risk of injury is significant as their motion is 90 degrees to the direction of passage and it may be too late to drive them out of the way, resulting in pedestrian injury. See FIG. 1*a,* where (100) are the Cabinets, (101) are the Retractable Leaves, and (102) is the Wedge Shaped Area below the leaves. It will be understood that Leaves (101) retract into Cabinets (100). Dimensions shown in FIG. 1*a* are provided to show the disadvantages of this type of barrier mechanism when blocking a wide passageway.

The second type of panel barrier unit typically places a pair of opposed panels or swing gates in a "saloon door" type fashion. Often bi-directional in their rotation about a fixed vertical axis, these panels are intended to always pivot away from the pedestrian. However, it is common that pedestrians in a two-way traffic situation are preoccupied or unwilling to wait their turn, and wind up walking into the edge of a panel or bar that is coming toward them. Since the pivot axis is fixed, the usual outcome of contact is pedestrian injury. There is also the instance where two-way traffic involves a percentage of wheelchair traffic. Since the swinging panels require a significant portion of the lane to swing out of the way, it is common that a swinging panel will crash into the footrests on the wheelchair. See FIG. 1*b,* where (103) are the Cabinets, (104) are the Saloon Doors, or Panels, (105) indicates the Significant Portion of the Lane to swing out of the way, and (106) indicates the Lane or Passageway.

The third type of panel barrier unit typically employs a pair of opposed translating panels in "pocket door" type fashion. It has the inherent disadvantage of the leaf unit in that it is difficult to properly support the panels, particularly full height ones, without an unusually large cabinet. It is common, primarily for aesthetics, that the majority of support occurs "invisibly" in the waist high cabinet, further stressing the design. There is a further issue that, when attempts are made to completely secure an entrance, these units require an additional fixed panel above the wide cabinet to preclude passage between two adjacent lanes. See FIG. 1*c,* where (107) are the Cabinets, (108) are the Fixed panels, (109) are the Pocket Doors, or Panels, and (110) indicates the Passageway. The dimensions shown in FIG. 1*c* are provided to show that completely securing the overall width of a unit which supports two pocket doors capable of blocking and clearing a 3'-0" ADA passageway, is in excess of 6'-0" in width inherently and the unit requires the Fixed Panels (108) to block an otherwise open space.

Common to all of the above, based on customer feedback, is a distinct lack of reliability across the entire spectrum of existing panel or swing gate designs as manufactured by others.

Further common to all of the above, is the need, at times, for expensive additional fabrications to make up the difference between the outer dimension of the units and the inside dimensions of the hallway or entryway. If the space to be secured is substantially wider than the unit, the typical method is a knee or full height wall on one or both sides of the unit. Since this involves attachment to the finished floor, or the finished wall, or the unit, at times of construction this can become an expensive last minute fabrication at considerable expense.

Yet another disadvantage of prior art devices is the difficulty, time, and expense associated with replacement of the unique glass panels, in the event of breakage. In most, if not all cases, significant disassembly of the unit is required, as well as waiting for the manufacturer's unique replacement panel. Specialized tools and skills are also typically required, increasing costs to the end user.

Accordingly, it is a principal object of the present invention to provide a barrier mechanism that is a reliable means of controlling a passageway.

It is a further object of the present invention to provide such a barrier mechanism that does not require a cabinet equal to approximately 50% of the passageway width.

It is an additional object of the present invention to provide such a barrier mechanism that does not present an immoveable leading edge to a person attempting to pass "in the wrong direction".

It is another object of the present invention to provide such a barrier mechanism that does not require the moving barrier to consume a large portion of the lane in the direction of passage.

It is yet a further object of the invention to provide such a barrier mechanism that does not inherently limit the supporting structure.

It is yet an additional object of the invention to provide such a barrier mechanism that does not require an additional panel above the cabinet in order to close the space between adjacent panel lanes.

It is yet another object of the invention to provide such a barrier mechanism that does not require expensive fabrications attached to finished surfaces to secure adjacent open space.

Yet a further object of the present invention is to provide such a barrier mechanism that does not require disassembly, special tools, skills, or a manufacturer-only replacement panel in the event of glass breakage of a panel.

Other objects of the present invention, as well as particular features, elements, and advantages thereof, will be elucidated in, or be apparent from, the following description and the accompanying drawing figures.

SUMMARY OF THE INVENTION

The present invention provides a barrier mechanism for providing selective access to a passageway on the floor of a lobby, room or pavilion, said barrier mechanism comprising in combination a frame having mounting supports for securement to the floor, said frame including a rail support substantially parallel to the passageway, a carriage assembly slidably movable in opposite directions along the rail support, a panel pivotally mounted to said carriage assembly, and being movable between positions selectively blocking said passageway or providing access to said passageway, a reversible motor on the frame, means connected between said motor and said carriage assembly, to initiate and complete the sliding movement of the carriage assembly and panel along the rail support, as the motor is energized, a bracket rigidly fixed to the panel, and projecting laterally therefrom, a turn link attached to the bracket on said panel, and multi-part linkage means connecting said turn link to said frame, for producing the pivotal movement of the panel with respect to the carriage assembly as the latter is slid along the rail support by the motor.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Reference should now be made to drawing FIGS. 2*a*-9, provided for purposes of illustration only, and on which the figure numerals in parentheses (when used) refer the reader to the figure in which the element(s) being described are more fully shown, although the element(s) may be shown on other figures also.

General

The invention is applicable to moving any substantially planar barrier, or panel, in that all advantages can apply whether the barrier is a series of vertical or horizontal bars affixed to a full or partial frame, or as in the initial target market, a glass pane of waist or full height.

In the case of a full height glass pane, the intent is to create an unattended entrance. It is further the intent to use the invention in tandem, such that an enclosed vestibule-type area, for observation and possible detention, can be created as a standalone product. This is desirable when the need to handle ADA traffic precludes the use of a revolving door or there is inadequate width for a pocket/sliding door or inadequate length for accommodating the swing of conventional entrance doors.

The same applies to hallways, which at times need to be secured with the maximum amount of width preserved for passage. However, the invention also includes a cost effective provision for securing entry and hallways when the width of the passageway to be secured is substantially wider than the unit itself.

The preferred method for moving the barrier is to rotate the panel on a carriage which is, in turn, able to translate, and to coordinate this compound motion in an advantageous fashion.

Figure 1A:
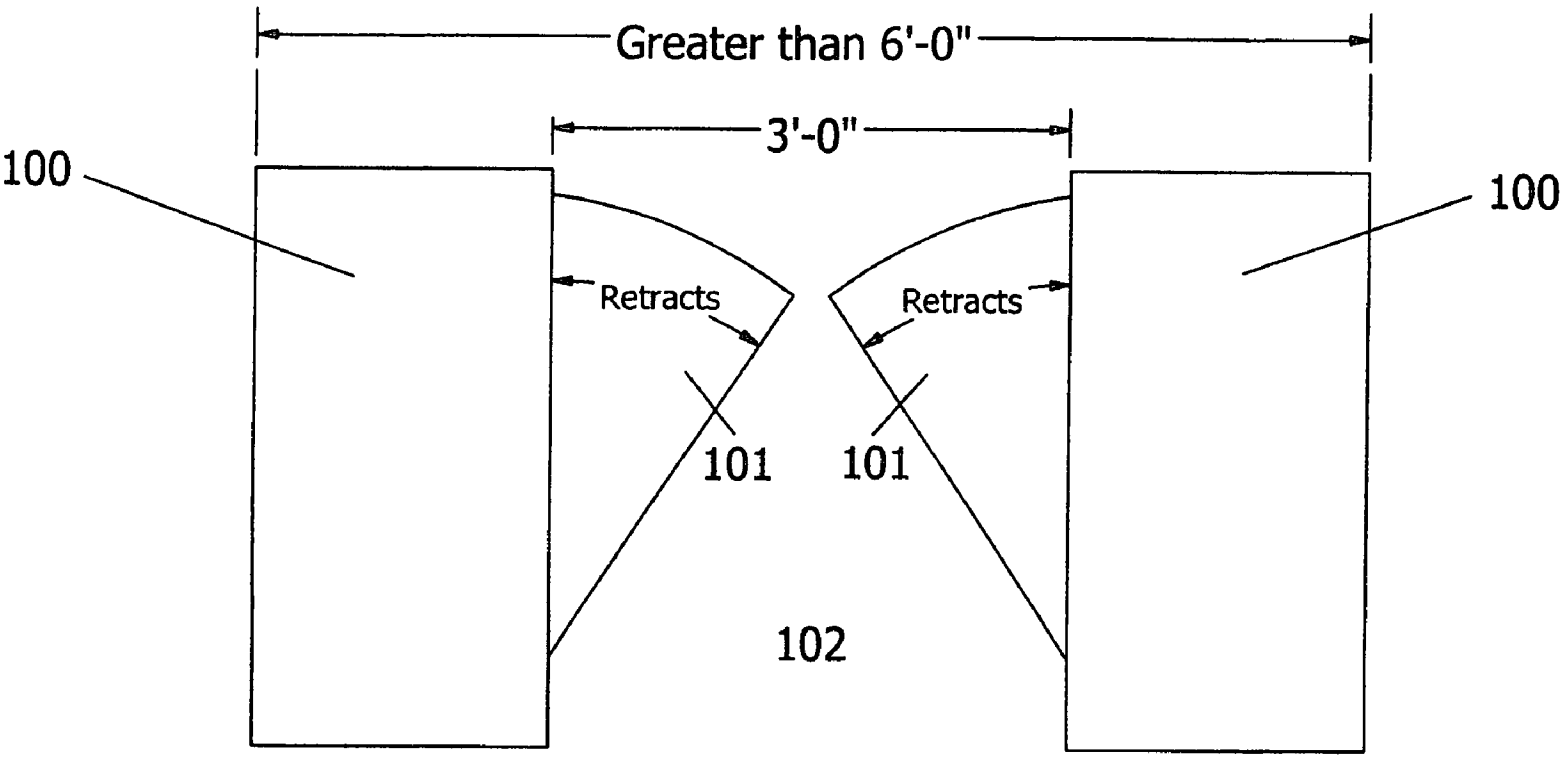
Fig. 1a (Prior Art)
FIG. 1*a* is a front elevational view of a conventional leaf type unit.
Figure 1B:
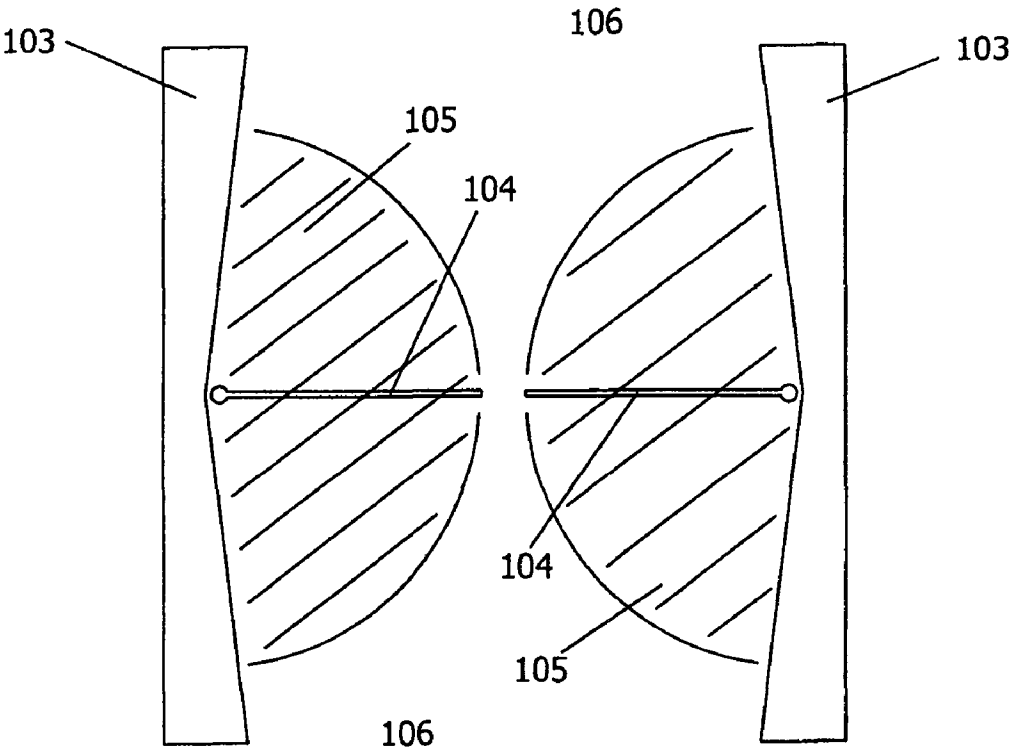
Fig. 1b (Prior Art)
FIG. 1*b* is a top plan view of a conventional swing gate or saloon door type unit.
Figure 1C:
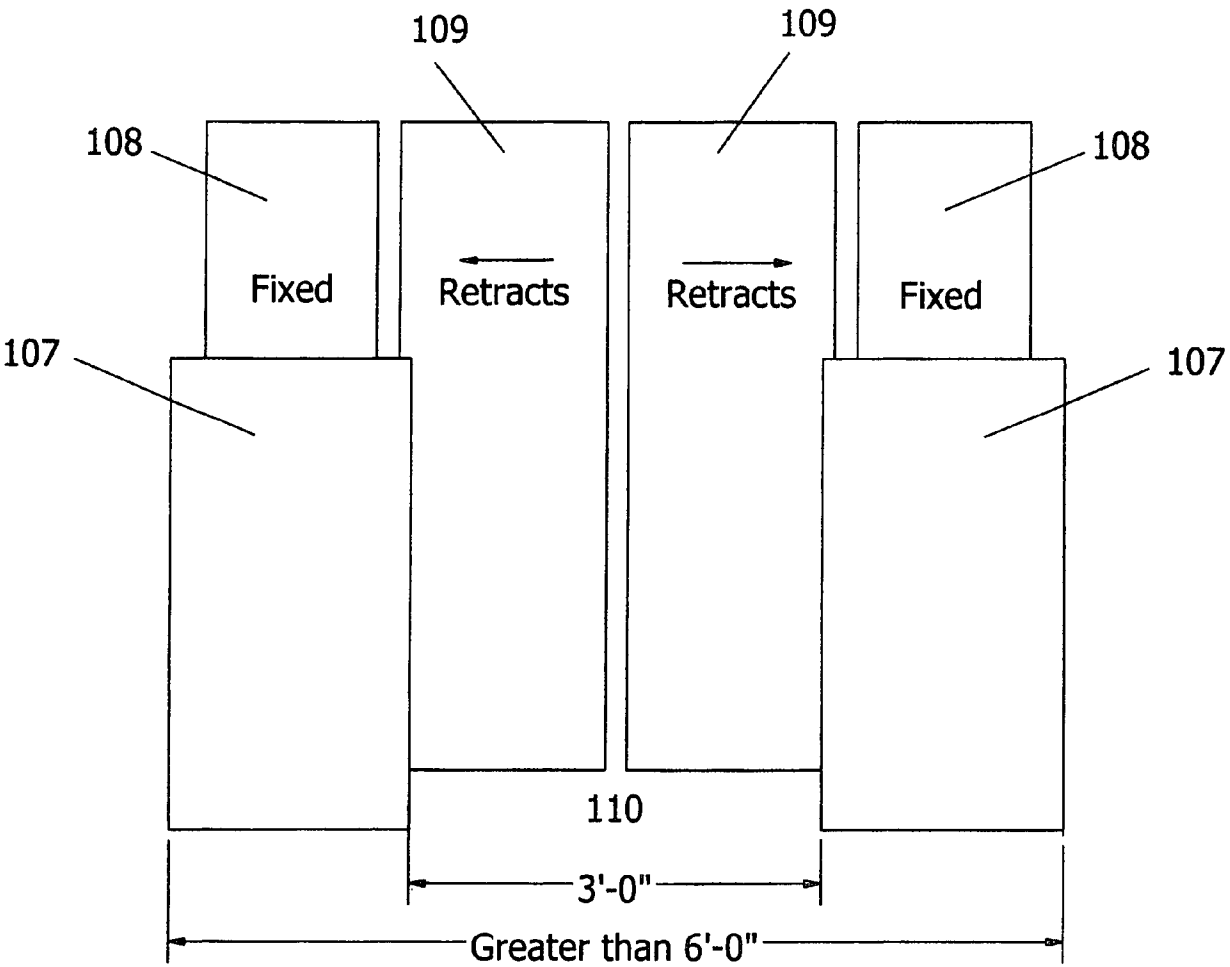
Fig. 1c (Prior Art)
FIG. 1*c* is a front elevational view of a conventional pocket door type unit.
Figure 2A:
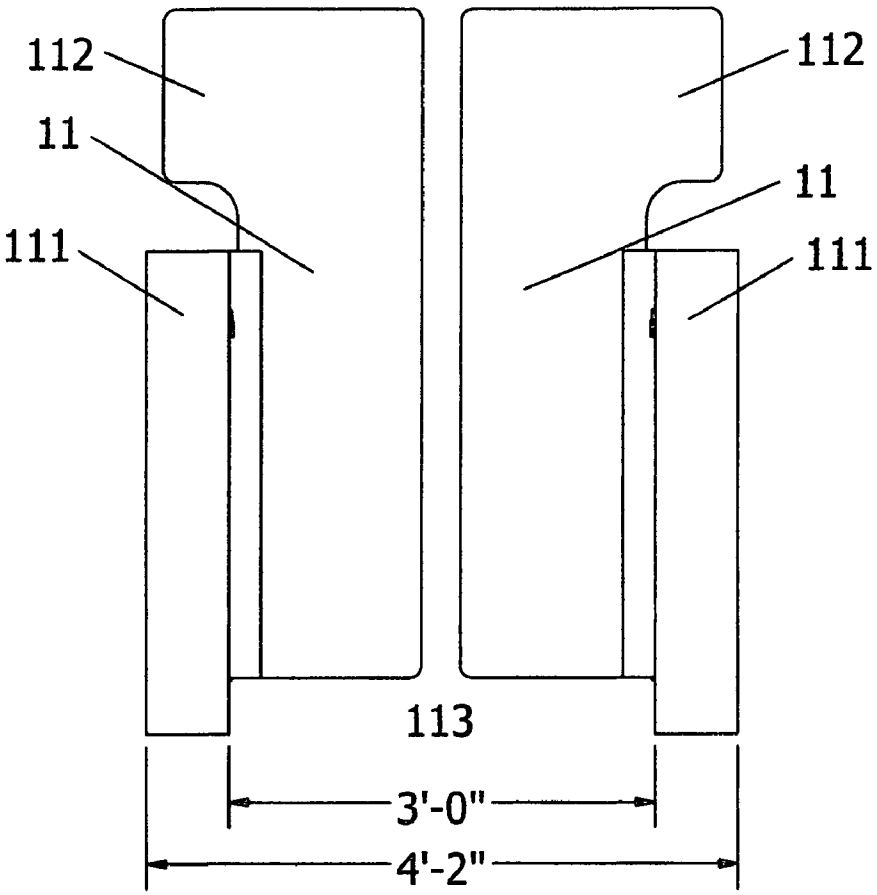
FIG. 2*a* is a front elevational view of the compound unit of the present invention.
Figure 2B:
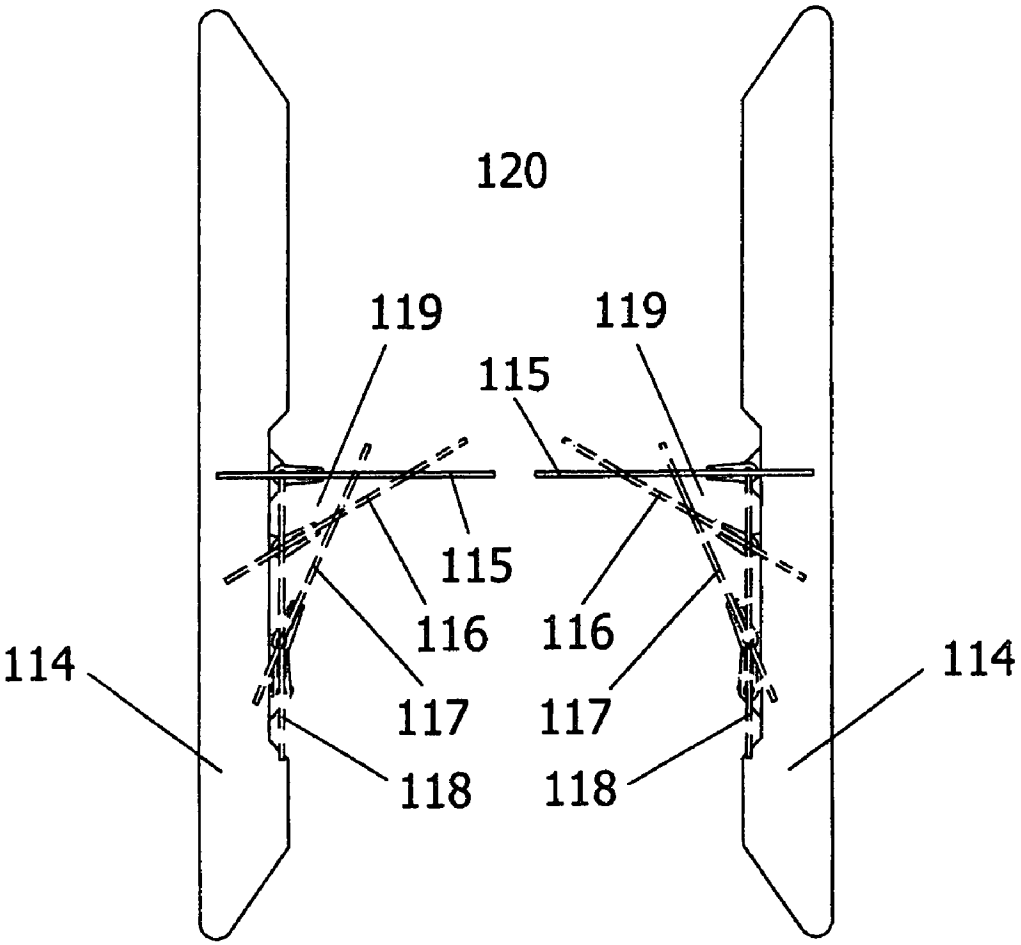
FIG. 2*b* is a top plan view of the compound unit of the present invention and shows the wraparound effect of the panel.

Typically, when securing a passageway and using a lobby as an example, there will be two panels opposing each other, with their hinge lines vertical and halfway, in the direction of passage, along the length of the cabinets as shown in FIG. 2*b*, where (114) are Cabinets, (115) indicate the Panels Closed and Blocking the passageway, (116) indicate the Panels about One-third Open, (117) indicate the Panels about Two-thirds Open, (118) indicate the Panels Fully Open or "unblocked", (119) indicate the Minimal Encroachment on the area of the passageway, and (120) indicates the Passageway. At this point, the appearance to a pedestrian approaching the device is essentially identical to that of a swing gate or saloon door type unit. However, when it is time to clear the passageway, the invention's hinge lines are translated towards one end of the cabinets, while the panels are rotated towards their cabinets. When the passageway is open, then, the edges of the panels are located where the hinge lines were previously, and the panels are stored parallel to the direction of travel. Note that while two opposed panels are described, narrow passageways can be blocked with a single panel from one side of the passageway.

The preferred method of linking the translation/rotation is in the complementary direction, as regards center of mass of the panel. If, for example, the panel were able to rotate freely, it would naturally tend to rotate in one direction as its hinge line is translated in a given direction. This is, in fact, the preferred overall relationship. This reduces the energy to effect motion of the panel.

While there is nothing to preclude execution of this system bidirectionally by translating the hinge line towards one end of the cabinet, at times, and towards the other end of the cabinet at other times, it is unclear that this bidirectionality affords significant advantage commensurate with the increased mechanical complication.

As can be seen in FIG. 2*b*, described above, rotating the barrier around a vertical axis while simultaneously translating this axis along the passageway, produces a "wraparound" effect which approaches the ability of a translating pocket-style to clear the center of the passageway, while reducing the cabinet width to that approaching the narrowness of a saloon door type. This motion, combined with the narrow dimension on the cabinet, permits a simple extension of adjacent full height panels in the area above the cabinet to block the space, thus eliminating the need for the separate panel. See FIG. 2*a*, where (11) indicate the Panel Assembly, (111) indicate the Cabinet, (112) indicate Simple Extension of the panel assembly, and (113) indicates the Passageway.

The preferred means of effecting the rotation/translation is in a prescribed combination, such that the panel follows a consistent or "wrap-around" path. The term "wrap-around" is used to characterize the panel motion which unblocks the passageway with minimal encroachment on the area where a pedestrian or wheelchair bound person is likely to be. The preferred combination of rotation and translation is non-linear, which is to say that the desired wrap-around effect improves with greater inches of translation/degree of door rotation at the extremes of travel. This also reduces the amount of encroachment of the inboard edge of the panel towards a pedestrian or wheelchair. However, rotation and translation in linear combination is also anticipated.

The preferred means of driving the combined rotation and translation is also non-linear, in that mechanical advantage of the driving means is higher at the extremes of travel, and lower towards mid-travel. The primary advantages of this are energy efficiency, smoothness of motion, safety, and locking.

If additional mechanical advantage is given to the driving means at the beginning and end of the opening and closing cycle, it reduces the energy required to start, and stop, the motion. If this mechanical advantage is reduced towards midtravel, when the panel which now already possesses significant inertia is most likely contacted by a pedestrian attempting to "beat the system", it improves their ability to overpower the unit.

It should also be noted that there are four potential collision combinations, and that the intent of the design is to reduce the risk of injury to the pedestrian in all cases.

The first case involves a pedestrian colliding with the panel from the "hinge side" while it is opening. In this case, the pedestrian will contact the panel and overdrive it in the direction it was already traveling. The angle of the panels gives the pedestrian additional leverage to accomplish this. The second case involves a pedestrian colliding with a panel from the hinge side while it is closing. In this case, the pedestrian will contact the panels and can even back drive the mechanics. The third case involves a pedestrian colliding with a panel from the "edge side" while it is opening. In this instance, the panels provide a means of easily overdriving the carriage in the direction it was going, while the linked rotation/translation opens the passageway. The fourth case involves a pedestrian colliding with a panel from the edge side while it is closing. In this case, the pedestrian will backdrive the carriage, and again the panels will open, not close as they would with a fixed hinge line saloon door type gate system.

It should also be noted that, as in the case where "no prior knowledge" theories of emergency egress apply, rotation of the panels in the exit direction with or without translating the carriage via spring loading the rotating panel to its driver arm are easily accomplished. Emergency egress in this manner is simply and cost effectively accomplished versus the pocket door style units which typically cannot rotate.

A potential conflict occurs with all units of this type between these last two requirements, which is specifically how does one provide a "no prior knowledge" manual means of immediate emergency exit, while providing unattended security in the entrance direction (since someone can simply pull a panel towards themselves and gain access)?

It is a preferred embodiment of this system that the building manager be given a choice as to which is considered the primary concern, free exit or security, and the unit be configured with an additional "active latch". Specifically, if emergency egress is the primary concern, the unit will only drive to the over-center or locked position when it senses, through conventional detection means, a person approaching it from the entrance side. If security is the primary concern, the unit will fully lock itself at the conclusion of each passage, and sense a person approaching it in the exiting direction, at which time it will drive itself to the unlocked side of the toggle action, or simply continue to full open.

As a reference, the opening of the passageway will typically take approximately 1 second. Closure of the passageway is typically preferred by the user to be 1.5 to 2 seconds. In the case of sensing/actively latching, this involves a very small portion of the driving cycle and can therefore be accomplished in less than 100 milliseconds, during which time a person can cover only a few feet, even if running, confirming that this is a totally practical solution.

Having discussed moving panels, it must be mentioned that the unit has the advantage of accepting fixed panels without requiring modification of the unit itself. In the example mentioned earlier where the width of the passageway to be secured is substantially wider than the unit itself, fixed panels can make up the difference between the outside dimension of the unit and the inside dimension of the passageway. These panels are essentially identical in construction and attachment to the unit, with the exception that they do not translate nor rotate, unless equipped with an optional lock that permits them to be moved as in the temporary case of cleaning the floor below. These panels are completely secured by the unit and therefore do not require attachment to either the floor or the wall. Therefore, they are simply deployed at the time of the installation. The clearance, typically 2" to a vertical surface, and 5" for a toe-kick below, reduces the criticality of knowing the exact dimension of a finished surface prior to installation, thus reducing errors, delays and cost.

Both moving and fixed panels on units are externally secured to the unit via a system which accepts commercially available wedge-lock jaws for ⅜" thick or ½ thick panels, used to grip the vertical edge of the panel. The integration with a vertical hinge supported by the carriage of, and recessed into, the unit affords the advantage of a "panel only" appearance in the passageway itself by eliminating the need for supporting the bottom of the panel. A further advantage of adopting this system is that it requires no holes to be drilled in the panel. This improves manufacturability, particularly with glass. It also allows a user to temporarily substitute any material of equivalent thickness, such as plywood, while waiting for a replacement panel. In the case of glass panels, any local manufacturer capable of making a common glass shower door has the requisite skills and equipment to make a replacement panel.

Replacement of a panel is facilitated by the design of the unit. Cycling the unit to the open position exposes the line of fasteners used to secure the commercially available jaws, which are otherwise inaccessible when the unit is in the secure position. After removal of a simple snap-in trim, the fasteners are loosened and any remnants of the damaged panel are wiped from the jaws. A new panel is inserted, the jaws are tightened to secure the panel, the trim snapped back in, and the unit is cycled back to the secure position, where the trim and fasteners are again inaccessible. The only tool required is a common Allen wrench.

Figure 3:
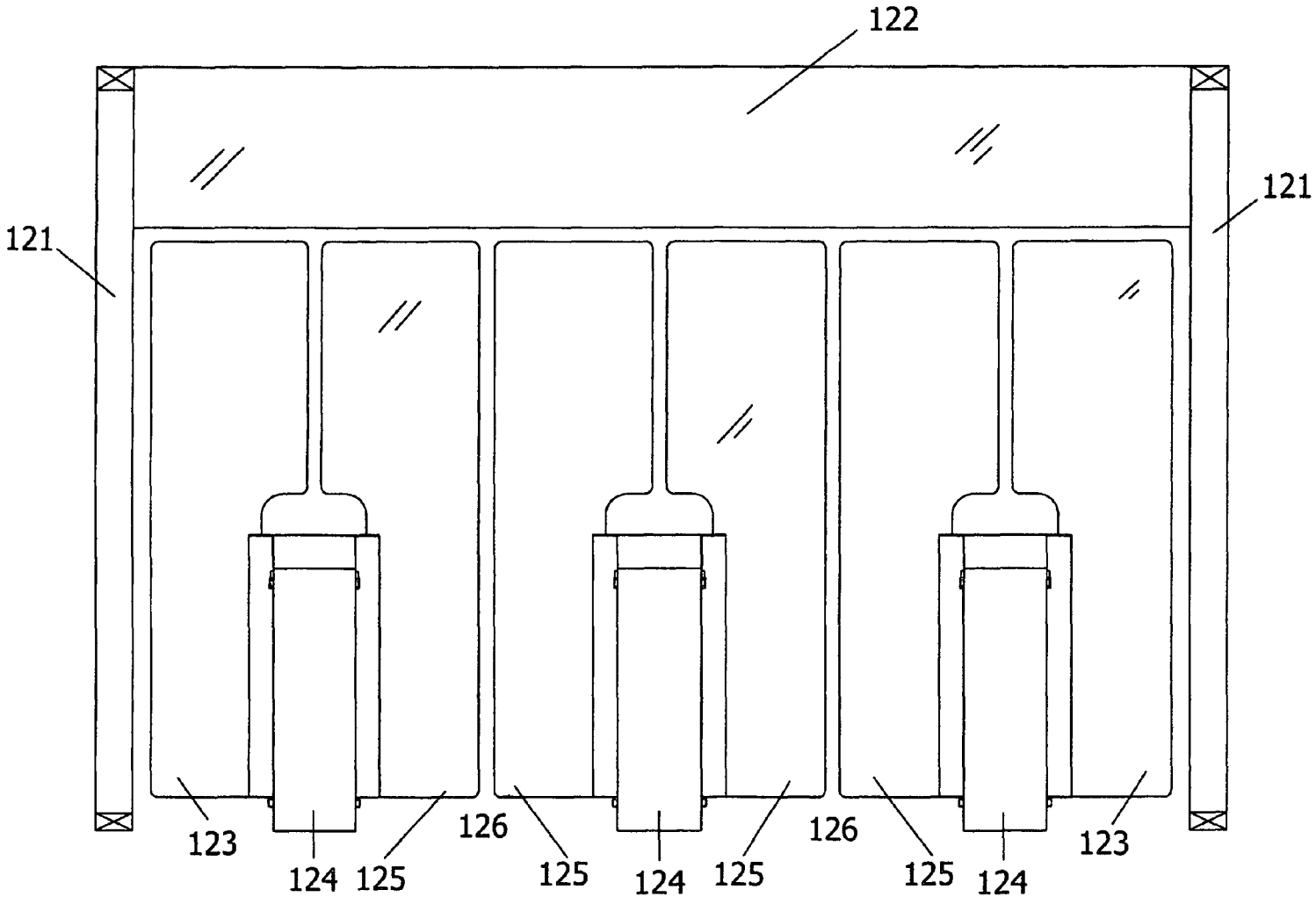
FIG. 3 is a front elevational view of a plurality of compound units of the present invention.

FIG. 3 illustrates a plurality of compound units constructed according to the present invention, where, (121) are the Walls of the passageway, (122) is an Overhead Panel, (123) are Stationary Make-up Panels, (124) are the Cabinets, and (125) are the Moving Panels.

DETAILED DESCRIPTION OF THE MECHANISM OF THE PRESENT INVENTION

Figure 4:
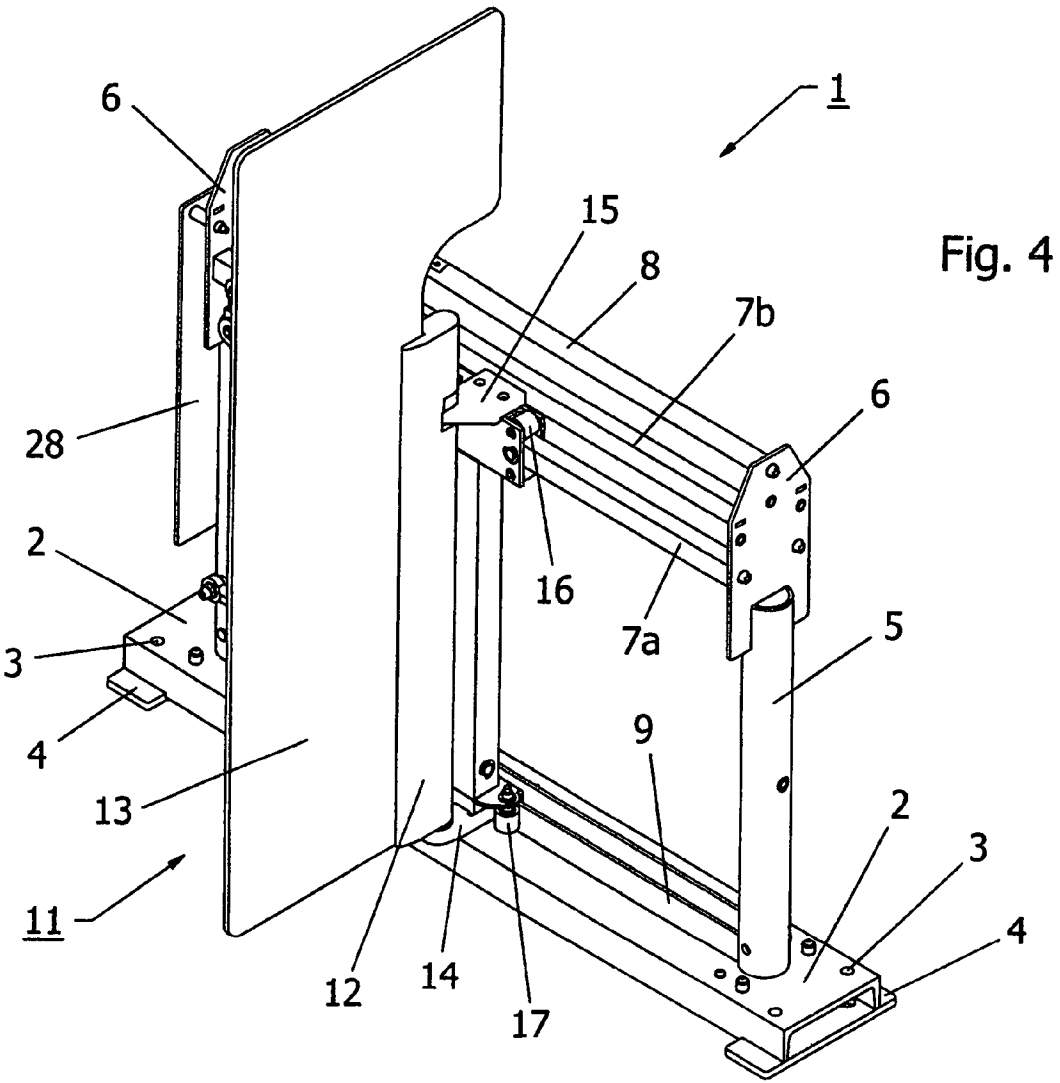
FIG. 4 is a front/side/top isometric view of the compound unit of the present invention.

FIG. 4 illustrates a set of Mechanics of a Barrier Mechanism, generally indicated by the reference numeral (1), that would typically comprise one side of a passageway. The structure consists of a Base (2) with Mounting Holes (3) and Feet (4) for the purpose of supporting, anchoring, and aligning the Mechanics or Barrier Mechanism (1) in the location to be secured. Pylons (5) and Rail Supports (6) are used to locate and support Rail (7*a*) and Rail (7*b*). An additional Crossbrace (8) can be used to improve the rigidity of the structure. A Guide (9) provides the remainder of the means to support and locate a Carriage or Carriage Assembly (10) (see FIGS. 5-6*e*), such that it can translate along the Rail (7*a*) and Guide (9). The Rail (7*b*) is used to support an additional carriage assembly, not shown, to secure the adjacent lane if required. The Guide (9) would be shared by both carriages.

FIG. 4 also reveals that the Carriage Assembly (10) supports the Panel Member or Panel Assembly, generally indicated by the reference numeral (11). The Panel Member of Panel Assembly (11) consists primarily of the Panel Mount (12) and the Panel (13). The Panel Assembly (11) is located by the Lower Hinge Assembly (14) and Upper Hinge Assembly (15). This permits the rotation of the Panel Member or Panel Assembly (11) when required. Upper Rollers (16) support and locate the Carriage Assembly (10) at the Rail (7*a*) and Lower Rollers support and locate the Carriage Assembly (10) (see FIGS. 5-6*e*) at the Guide (9).

It is noted at this time that this method of creating a structure is intended to provide an easy and cost effective means of creating a tandem panel assembly or vestibule result. Specifically, lengthening the Base (2) as well as the Rail (7*a*), Rail (7*b*), and Crossbrace (8), and using as many Mounting Holes (3), Feet (4), Pylons (5), and Rail Supports (6) as deemed necessary for support, allows one to add additional carriage assemblies on the same rail. A "man trap" is a higher security product which can detain one between tandem panels.

Figure 5:
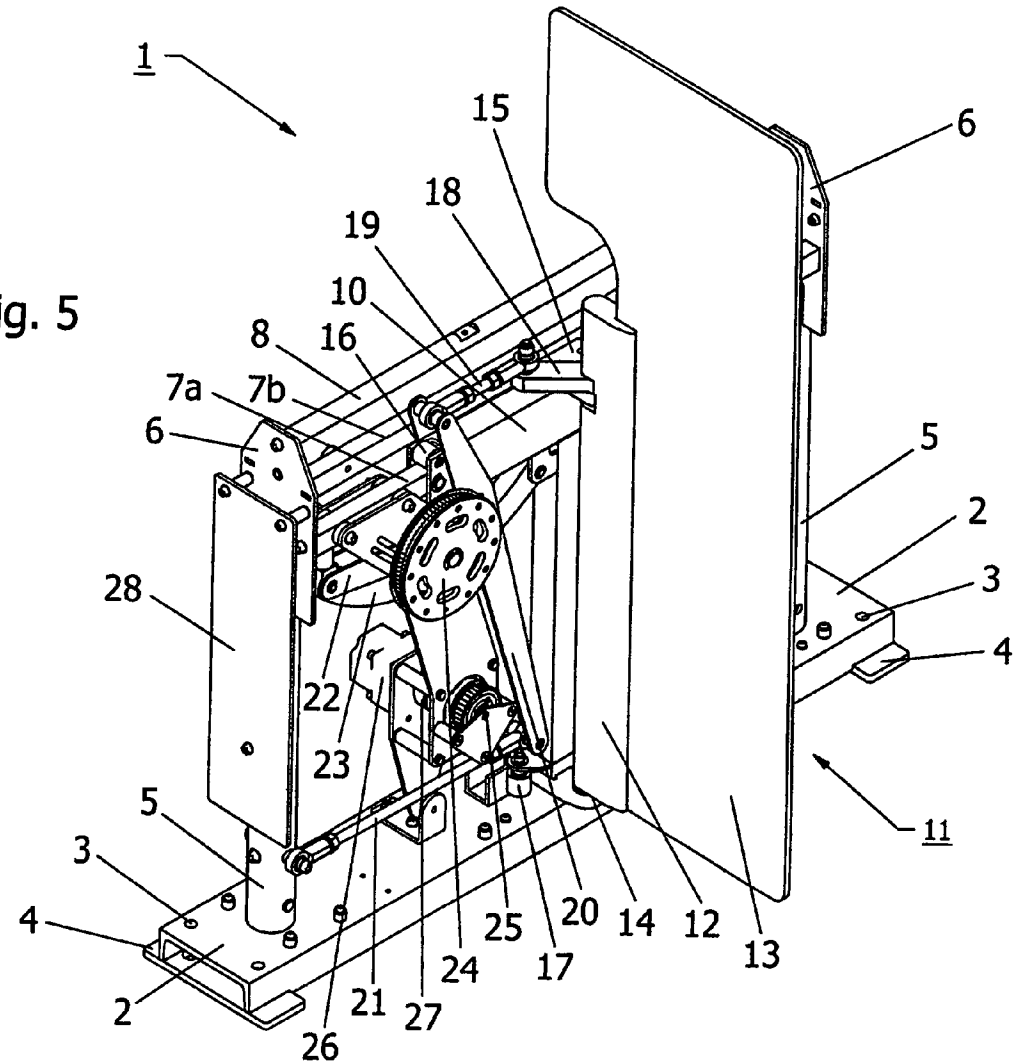
FIG. 5 is a rear/side/top isometric view of the compound unit of the present invention.

FIG. 5 illustrates the principal components used to effect the turning component of the motion. The Bracket or Horn (18) is the means by which the Panel Assembly (11) can be rotated, it being attached to the Panel Mount (12). The Turn Link (19) connects the Bracket or Horn (18) to the end of the Rocker (20). The Turn Link (19) can be thought of as a rocker linkage means. The actual type of connection can vary, however the unit depicted utilizes common threaded rod ends which are a ball joint type of connection. The Rocker (20), whose pivot is located on and moves with the Carriage Assembly (10), is actuated by the Anchor Link (21), which is, in turn, attached to the Pylon (5). It is again noted that the connection at both ends of the Anchor Link (21), like the Turn Link (19), are ball joint type.

Summarizing the turning means, movement of the Carriage Assembly (10) towards the far end of the unit, as shown in FIG. 5, and substantially restraining the lower portion of the Rocker (20) causes the upper portion of the Rocker (20) to advance the Horn (18) and therefore turn the Panel Assembly (11) clockwise when viewed from the top.

FIG. 5 also reveals the means used to effect the translational motion of the Carriage Assembly (10) along the Rail (7*a*) and Guide (9).

A Driver or crank arm means (22) moves the Link (23) when rotated by the Upper Pulley (24) about the axis they share. The Lower Pulley (25) drives the Upper Pulley (24) via a timing belt (not shown for clarity but easily envisioned). In the example shown, the Lower Pulley (25) is coaxially driven via a Gearmotor (26) through a MultiDisk Clutch (27). The MultiDisk Clutch (27), it should be noted, is of the continuous slip type, such that any prolonged blockage of the Panel Assembly (11), or fault of the unit, will not damage the system. Further, it is slippage at the MultiDisk Clutch (27) that allows a user of the unit to overpower or backdrive the system in the event of inadvertent contact during panel movement. This is a significant safety feature.

Summarizing the translating means, the Driver (22), as shown in FIG. 5 when rotated counterclockwise will drive the Carriage Assembly (10) towards the far end of the unit via the Link (23).

Figure 6A:
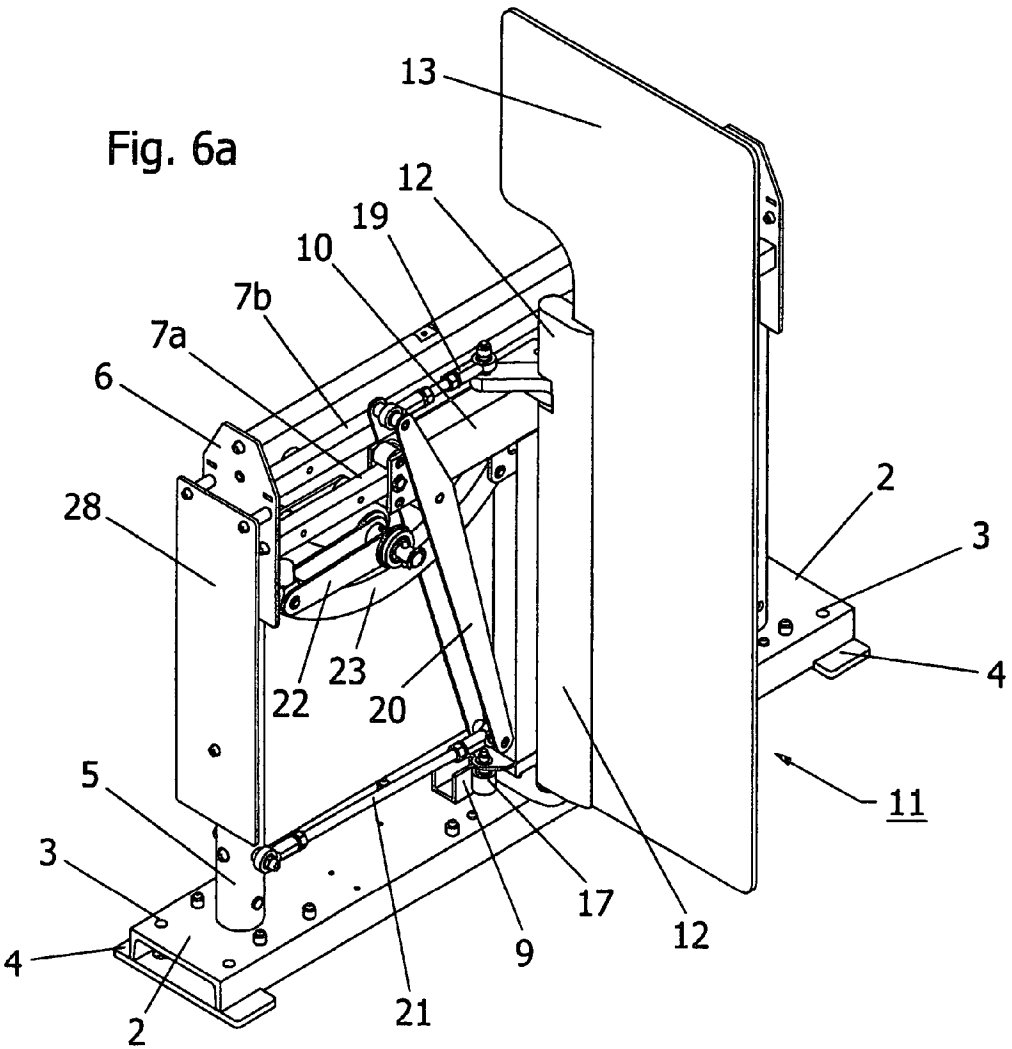
FIGS. 6*a*-6*e* are rear/side/top isometric views of one side of the compound unit of the present invention from closed to open position, with certain of the elements thereof removed for clarity.

To further clarify the object of the Mechanics, refer to the sequence of the motion commencing with FIG. 6*a*. Components have been removed from the view such that the relationship of the Driver (22), Link (23), Carriage Assembly (10), Panel Assembly (11), Rocker (20), Turn Link (19), and Anchor Link (21) can be more easily discerned.

In FIG. 6*a*, the Driver (22) is in a horizontal position, and the Panel Assembly (11) is blocking the passageway.

Figure 6B:
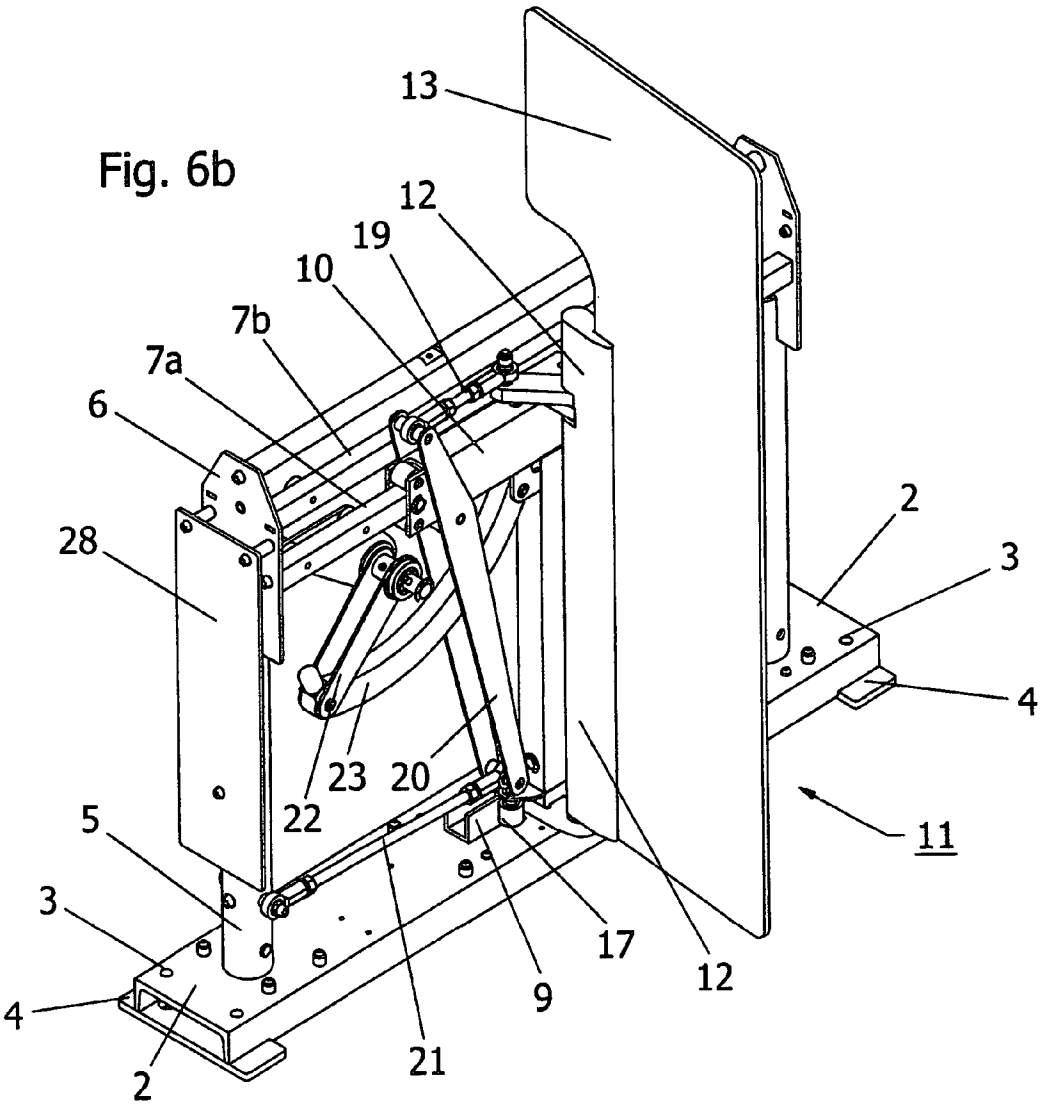

Progressing to FIG. 6*b*, the Driver (22) has rotated 45 degrees counter-clockwise and the Carriage Assembly (10) has just started to move, while the Panel Assembly (11) has just started to rotate about its vertical axis. This apparent lack of movement is intentional. Whether FIG. 6*b* represents the beginning of the open cycle or the end of the close cycle, the geometry is such that the user can easily overpower the mechanism if he were to inadvertently contact or otherwise bump the Panel Assembly (11), due to the relatively low mechanical advantage the Driver (22) and Link (23), a key safety feature. In the case of no prior knowledge egress requirements, and in the "active latching" mode described earlier, it is typically this state that the unit "idles". If a person were to exit, going from right to left as the view is captured, a simple push on the panel would open the lane.

Again referring to FIG. 6*b*, it can be envisioned that with a pair of opposed panels blocking a single lane, the space between the two is at this point relatively small. Given the aforementioned poor mechanical advantage of the driver and link arrangement, it is easy to see that this arrangement reduces the possibility of excessively squeezing an object or person, as he can simply "push back". This is a key intent and safety feature of this invention.

Figure 6C:
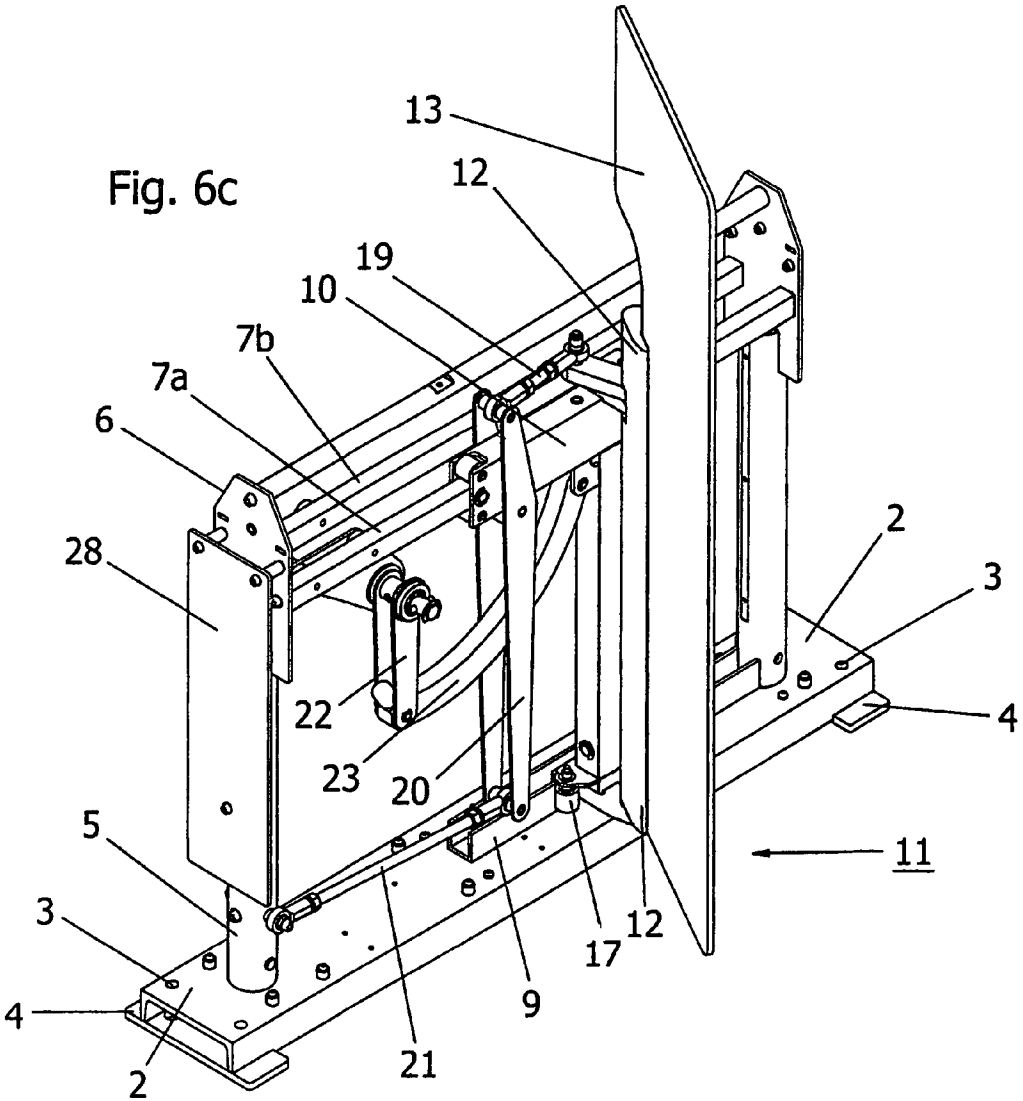

Now referring to FIG. 6*c*, the Driver or crank arm means (22), has rotated an additional 45 degrees counter-clockwise from the position depicted in FIG. 6*b*. Significant translation of the Carriage Assembly (10) and rotation of the Panel Assembly (11) can now be observed. However, it is again an intent of the invention that the end of the Panel (13) remain as close as practical to the mid point of the unit. Significantly and intentionally, the end of the Panel (13) does not appreciably advance towards either end of the unit, as described earlier. The movement of the free end of the Panel (13) is very similar to a leaf or pocket style panel unit. This reduces the risk of the panel hitting a wheelchair footrest or an impatient person, either of which is most likely to be in the middle of the passageway.

Figure 6D:
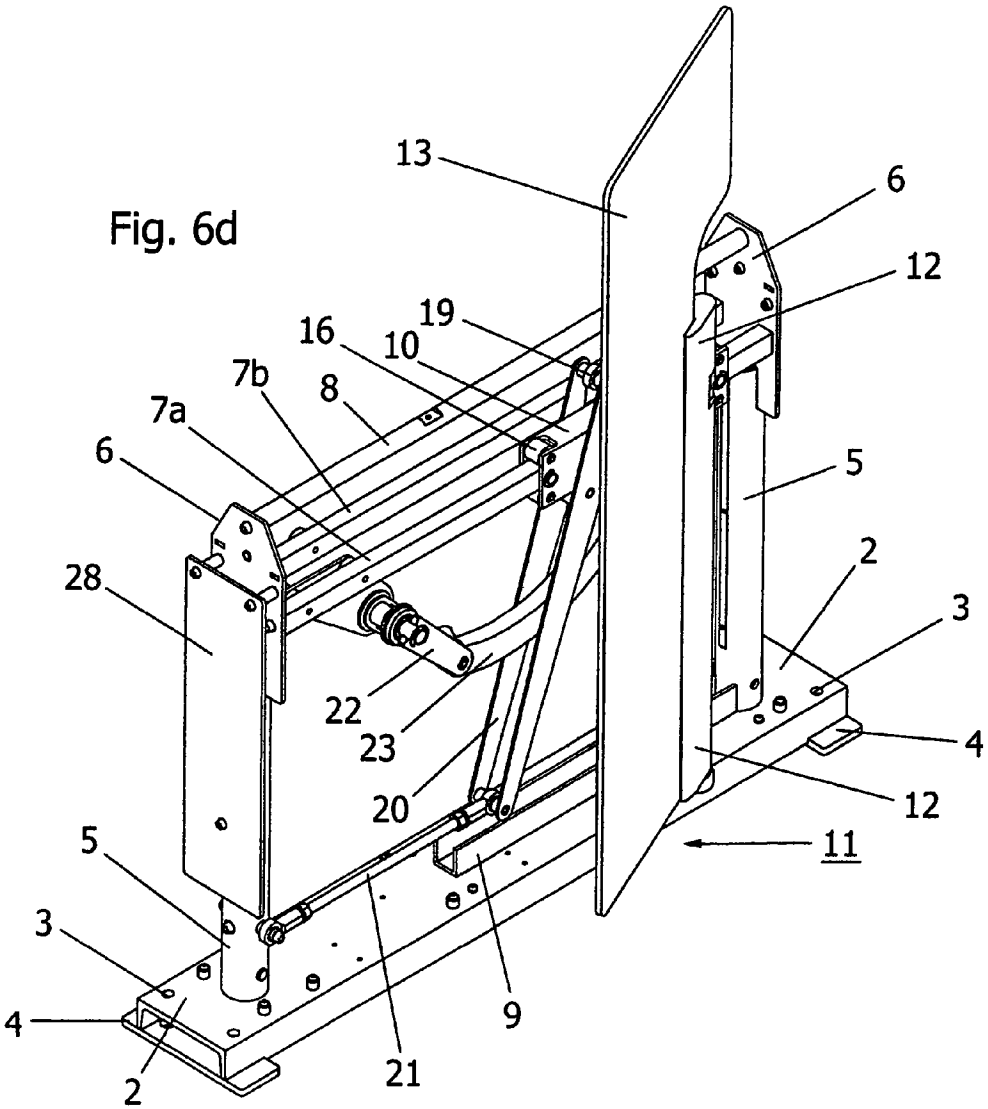

The next phase of the motion is depicted in FIG. 6*d*. FIG. 6*d* shows the Driver (22) rotated an additional 45 degrees relative to FIG. 6*c*. It can again be seen that the free end of the Panel (13) essentially remains at the midpoint of the unit, and the majority of the Panel (13) is nearly out of the passageway. As will be seen later, the hinged end of the Panel Assembly (11) is actually inboard of the front profile of the cabinet enclosing the Mechanics (1) and not in the actual passageway. The chances of the panel assembly striking a user or wheelchair are very low at this stage. However, at this stage of motion, contacting the free end of the Panel (13), regardless of from which direction the person came, will simply further advance the motion of the panel. As discussed earlier, this is a significant advantage over a saloon door type unit. With a saloon door type unit, running into the end of the panel in the direction of the plane of the panel equals running into a rigid barrier with an edge, and injury is the likely result.

Envisioning the unit in motion, as aided by comparing FIG. 6*c* to FIG. 6*d*, illustrates the "wrap-around" effect described earlier. It is a key feature of the invention that the panel "wrap-around", not contact, the user.

Figure 6E:
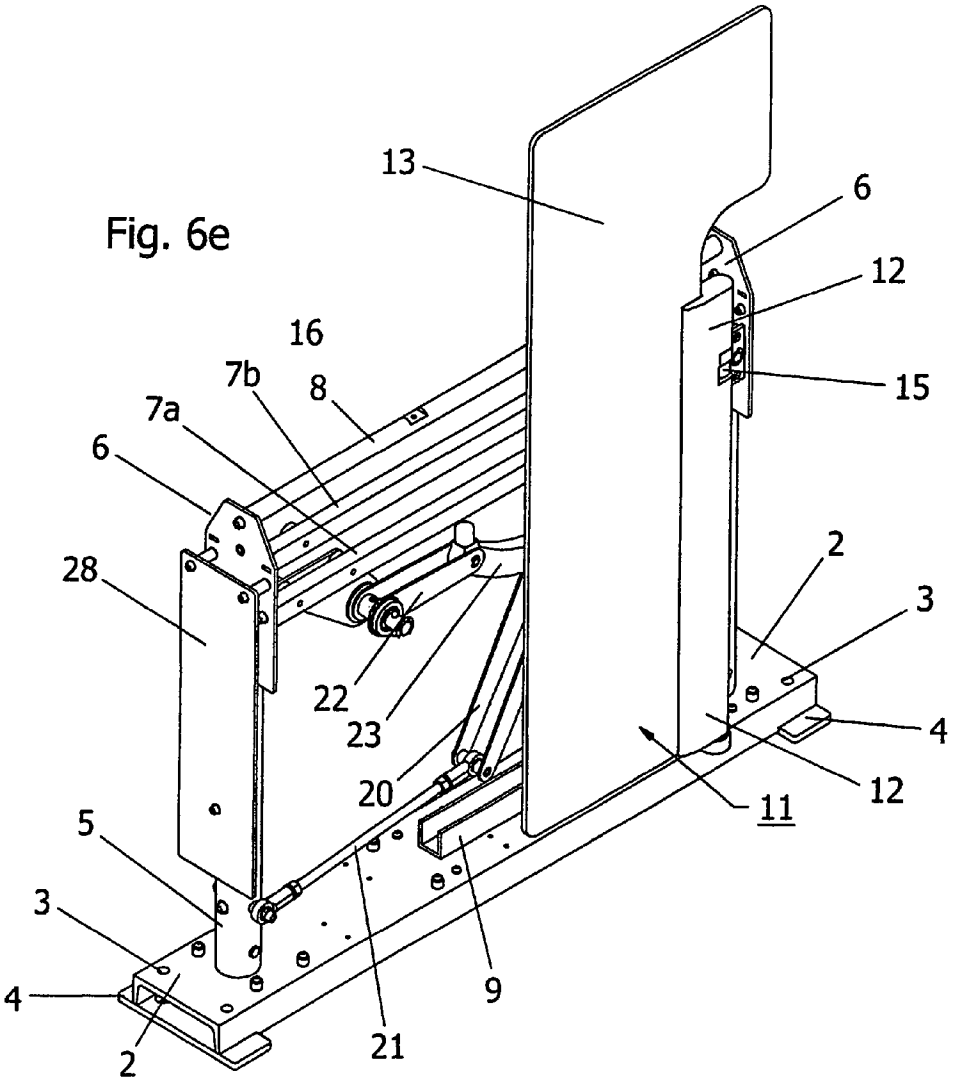

FIG. 6*e* depicts the Driver (22) rotated a full 180 degrees from the position depicted in FIG. 6*a* and the passageway is now completely clear, or open. The Panel Assembly (11) is now stored in a recess of the enclosure, if that is the preference and style of the cabinet design.

As regards the closing of the passageway, and regressing from the open state depicted in FIG. 6*e* to FIG. 6*d*, it can be seen that if a constant speed Gearmotor (26) is used, the Mechanics (1) "give notice" in actual use. Specifically, in actual use the user discerns that "something is happening" before the Panel (13) moves substantially into the passageway, again a safety feature. The mechanics could of course include a variable speed motor, and a "soft start" can be achieved via electronic control, but the inherent characteristics of the mechanism render the more costly approach unnecessary.

FIGS. 6*a*-6*e* can also be used to illustrate another advantage of this method of moving a panel, which is to reduce energy requirements. Earlier, it was mentioned that the preferred embodiment featured a complementary rotation and translation. If one pictures the Mechanics (1) with the Turn Link (19) removed, and what would happen if the unit were cycled, it is easy to see that the location of the center of mass of the Panel Assembly (11), and its inertia, would cause it to "automatically" rotate in the same direction it does with the Turn Link (19) installed. This complementary motion, coupled with the roller-supported Carriage Assembly (10), results in an extremely efficient system. Cycling units continually at 1,000 passages per hour consumes less than about 35 watts/panel, by actual measurement.

In accordance with the present invention there has been provided a novel mechanism which provides selective access to the passageway on the floor of a lobby, room, or pavilion, by a pedestrian, and including a novel means for locking the carriage assembly and panel, either when the panel is in the blocking position preventing access to the passageway, or the access position, wherein the panel is folded back and nested against the frame, out of the path of pedestrians using the passageway.

Figure 7:
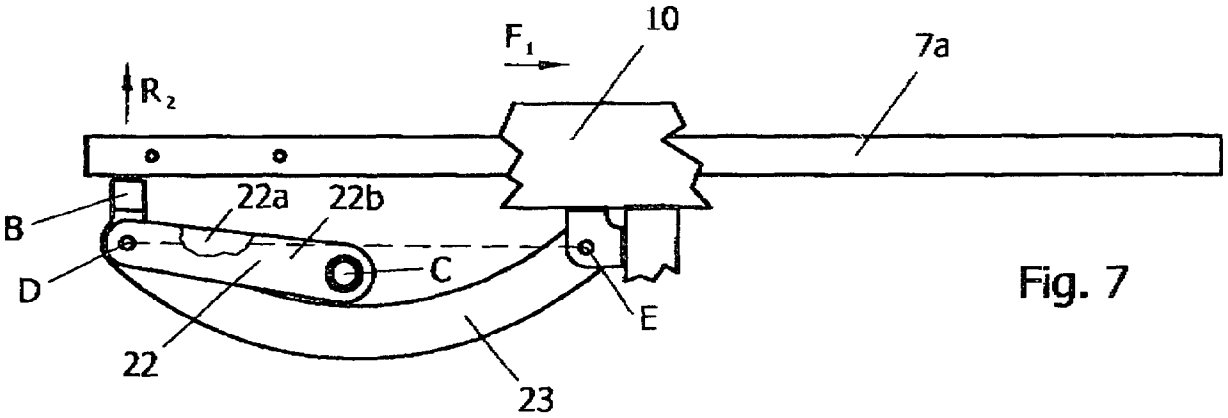
FIG. 7 is a fragmentary diagrammatic side elevational view, enlarged, of the Rail, Carriage Assembly, Driver, and Link, in the relative positions they occupy when the Panel is disposed in a blocking position, and wherein it is locked in such a position by an over-the-center arrangement of the parts.
Figure 8:
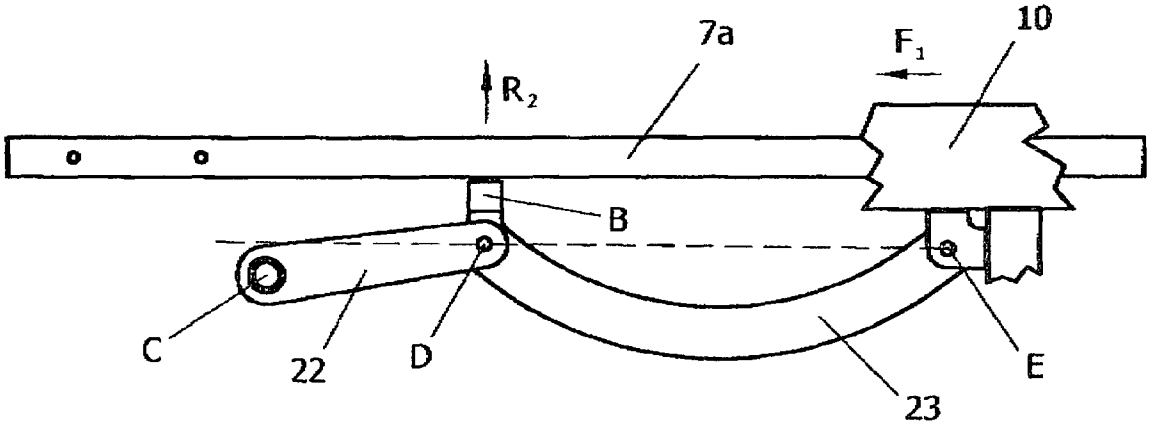
FIG. 8 is a view like FIG. 7, except showing the parts corresponding to a nested or unblocked position of the Panel.
Figure 9:
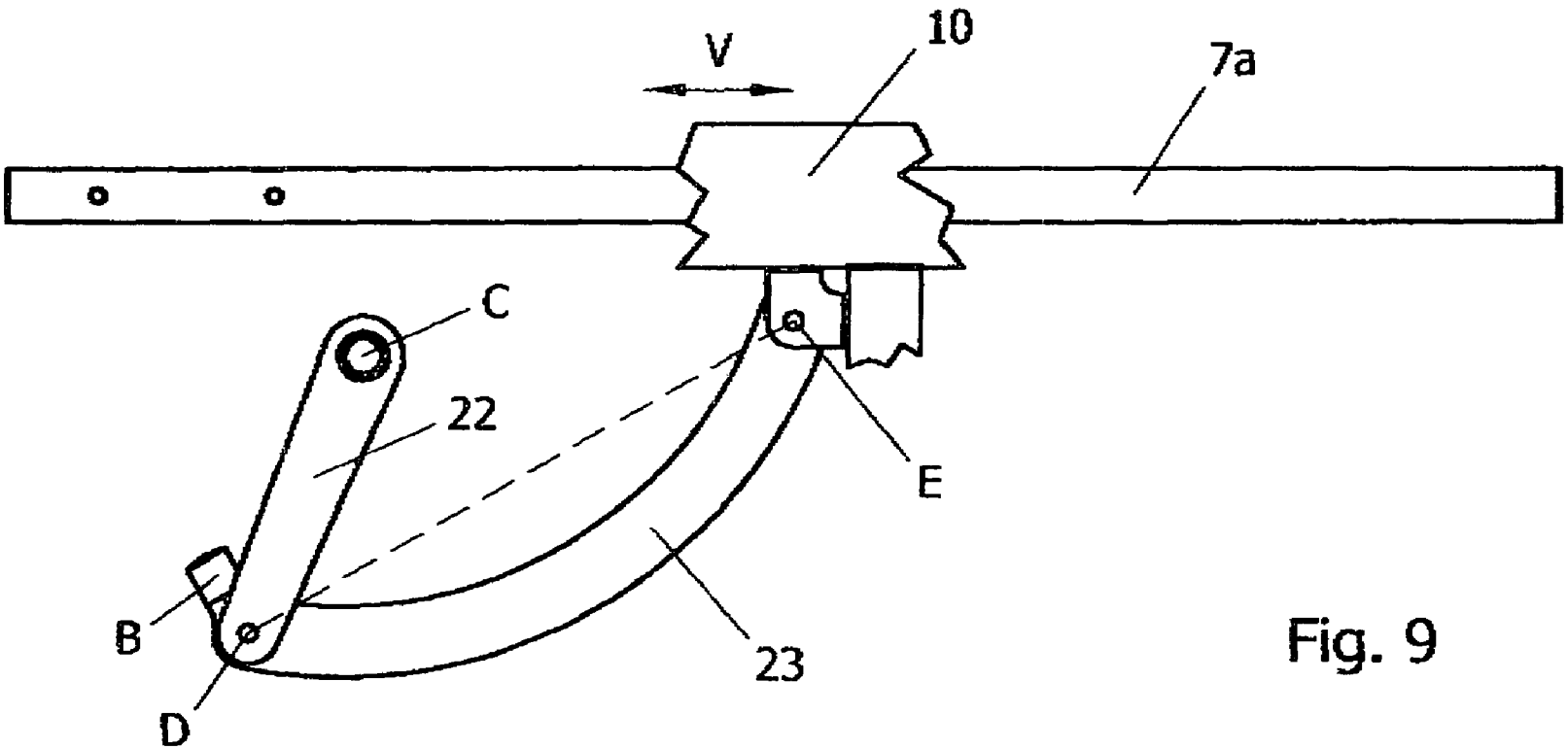
FIG. 9 is a view like FIGS. 7 and 8, except showing the parts corresponding to an intermediary position of the Carriage Assembly and Panel, wherein the Carriage Assembly and Panel can be moved if the panel is accidentally bumped or jarred by personnel coming into inadvertent contact with it.

The locking feature is best illustrated in FIGS. 6*a*, 6*e* and 6*c*, respectively, showing the panel in the blocking position, the nested, access position and an intermediate position. Reference is made to FIGS. 7-9 in addition. FIG. 7 shows the relative positions of the Carriage Assembly (10) on the Rail (7*a*). Driver (22) and Link (23) are shown therein. Driver (22) comprises two spaced apart Legs (22*a*) and (22*b*), which accept the Link (23) and allow it to nest therebetween. The Pivot Axes are labeled (D), (C), and (E). Driver Axis (C) is fixed laterally, and capable of rotation. It is power driven by the reversible Gearmotor (26) and Drive Pulley arrangement (24), (25). A Bumper (B) is attached by suitable means, to the end of the Link (23).

The means connected between the motor and the carriage assembly and which initiate and complete the sliding movement of the carriage assembly and panel along the rail support, as the motor is energized, comprises the Driver (22) and the Link (23).

Referring again to the operation, FIG. 7 illustrates the Carriage Assembly (10) occupying a position along Rail (7*a*) corresponding to a blocking disposition of the panel, as shown in FIG. 6*a*. Driver (22) has been driven counterclockwise in FIG. 7, until the Bumper (B) engages the Rail (7*a*). Under this circumstance and in the event of a pedestrian attempting to dislodge the panel from its locked position, the force on the panel, translated to the Carriage Assembly (10) will be in the direction of F1 in FIG. 7. Since the imaginary line between Pivot Axis (D) and Pivot Axis (E) is "inboard" of Driver Axis (C), the net effect of force F1 will be for the Bumper (B) to be restrained by the Rail (7*a*), by a force indicated by R2. That the Driver (22), or the Link (23), or the Carriage Assembly (10), are restrained, can be readily understood. The relative dispositions of the Driver (22), Link (23) and Carriage Assembly (10), creating the relative locations of Axes (D), (C), and (E) constitutes an over-the-center condition, which resists the undesired yielding of the Carriage Assembly (10) and Panel Assembly (11). Summarizing, the force F1 produces a corresponding force R2 engaging the Rail (7*a*), and no significant movement of either the Driver (22), Link (23) can occur. Correspondingly, the Carriage Assembly (10) cannot move in the direction of the force F1 being applied to it by the Panel Assembly (13), therefore the Panel Assembly (11) cannot rotate so as to open the passageway.

FIG. 8 shows the relative positions of the Driver (22), Link (23), and Carriage Assembly (10), when the panel is in an unblocking position, or nested position against the frame. This corresponds to the showing of FIG. 6*e*. If designed properly, the Panel (13) can fit completely within the confines of the frame, so as to appear unobtrusive to passing personnel.

By the invention, an over-the-center structure in FIG. 8 can achieve a lock function for the panel in the detail showing of FIG. 6*e*. Returning to the operation, the Driver (22) Link (23) having the relative positions of FIG. 6*e*, will hold the Carriage Assembly (10) against movement.

More specifically, an attempt to vandalize, or pull the panel from the nested position of FIG. 6*e*, will result in a force F1 being applied to the Carriage Assembly (10). This in turn will result in an applied force R2 by the Bumper (B). However, since the Driver Axis (C) is "outboard" of the imaginary line drawn between Pivot Axes (D) and (E), the Link (23) cannot move, and the force F1 will be resisted. Correspondingly, the panel cannot be dislodged from the nest position of FIG. 6*e*. The relative dispositions of the Driver (22), Link (23) and Carriage Assembly (10), creating the relative locations of Axes (D), (C), and (E) constitutes an over-the-center condition, which resists the undesired yielding of the Carriage Assembly (10) and Panel Assembly (11).

Further, in FIG. 9, there is illustrated a condition wherein the Panel Assembly (11) occupies an intermediary position between blocking and access. The relative positions of the components of FIG. 9 is as shown. If the panel is inadvertently bumped or jarred by a pedestrian or possibly a vandal, the Carriage Assembly (10) will experience a force causing it to move in either direction on the Rail (7*a*), such movement being indicated by the translation-type designation V. Since the links are not in an over-the-center configuration, little resistance will be felt, the Carriage Assembly (10) will translate, and the Panel Assembly (11) will rotate. As noted elsewhere in the present application, this yieldability of the panel can be an important safety factor if the panel is inadvertently left in an intermediate position.

Figure 10:
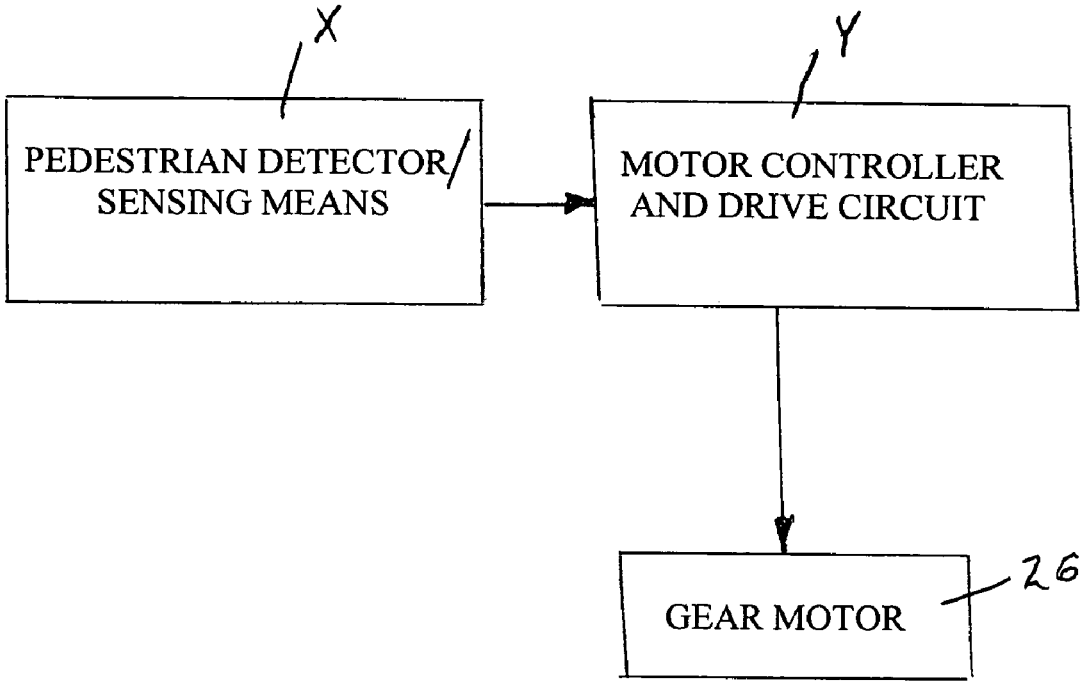
FIG. 10 is a block diagram of automated system for detecting the presence of a pedestrian or other personnel, and for generating a control signal to operate the Motor in such a way that the Panel assumes a blocking disposition, or alternately, an access position, for compliance with pre-existing safety and/or emergency procedures.

A further feature of the present invention is depicted in FIG. 10, which is a block diagram for automatic control of the Panel in direct response to the approach of a pedestrian or other personnel. The pedestrian detector/sensing means designated (X), can as an example, be a series of infrared detectors, utilized in what is known in the trade as a "through beam" or "opposed beam" system. Multiple units can be utilized to cover the specific expanse desired, and located in a cabinet for the frame.

In operation, when a pedestrian passes one or more infrared detectors, the latter trigger a Motor Controller and Drive Circuit (Y) (shown in block diagram form, FIG. 10) which in turn energizes the Gear Motor (26). In a situation where egress is mandated, the Panel Assembly (11) will be opened and locked, by the over-the-center arrangement already described in connection with FIGS. 7-9. In other situations involving emergencies, the Motor Controller and Drive Circuit (26) can be made to close the Panel Assembly (11) and block access through its corresponding passageway. Alternately, if conditions dictate that an access past the Panel Assembly is warranted, the Motor Controller and Drive Circuit (Y) can be preprogrammed to accomplish this. The particular control will be largely the result of conditions prevailing in a given situation or the result of building codes prevailing in the particular lobby, room or pavilion.

It is intended that with the embodiments of the present invention as described above, individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "inboard", "outboard", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

Partial List of reference numerals:

| | |
|---|---|
| 1 | Barrier mechanism Frame, Mechanics |
| 2 | Base |
| 3 | Mounting holes |
| 4 | Feet |
| 5 | Pylons, Mounting Supports |
| 6 | Rail supports |
| 7a | Rail |
| 7b | Rail |
| 8 | Crossbrace |
| 9 | Guide |
| 10 | Carriage Assembly |
| 11 | Panel Assembly |
| 12 | Panel Mount |
| 13 | Panel |
| 14 | Lower Hinge Assembly |
| 15 | Upper Hinge Assembly |
| 16 | Upper Roller |
| 17 | Lower Roller |
| 18 | Bracket or horn |
| 19 | Turn Link |
| 20 | Rocker |
| 21 | Anchor Link |
| 22 | Driver, crank arm means |
| 23 | Link |
| 24 | Upper Pulley |
| 25 | Lower Pulley |
| 26 | Gearmotor |
| 27 | Clutch |

The embodiments of the invention in which an exclusive property or privilege is claimed, are defined as follows:

1. A barrier mechanism for providing selective access to a passageway on one of the floor of a lobby, room or pavilion, said barrier mechanism comprising in combination:

a) a frame having mounting supports for securement to the floor, b) said frame including a rail support substantially parallel to the passageway, c) a carriage assembly slidably movable in opposite directions along the rail support, d) a panel pivotally mounted to said carriage assembly, and being movable between positions selectively blocking said passageway or providing access to said passageway, e) a reversible, motor on the frame, f) means connected between said motor and said carriage assembly, to initiate and complete the sliding movement of the carriage assembly and panel along the rail support, as the motor is energized, g) a bracket rigidly fixed to the panel, and projecting laterally therefrom, h) a turn link attached to the bracket on said panel, and i) multi-part linkage means connecting said turn link to said frame, to produce the pivotal movement of the panel with respect to the carriage assembly as the carriage assembly is slid along the rail support by the motor.

2. The invention as set forth in claim 1, wherein:

a) said connected means comprises link and a driver which takes the form of a strut which has spaced apart legs that straddle the link.

3. The invention as set forth claim 2, wherein:

a) said driver and said link are separate and distinct from said multi-part linkage means.

4. The invention as set forth in claim 1, wherein:

a) said turn link comprises a strut having one end connected to the bracket by a ball joint.

5. The invention as set forth in claim 4, wherein:

a) said multi-part linkage means comprises an anchor link having one end connected to the frame by a rod end.

6. The invention as set forth in claim 5, wherein:

a) said multi-part linkage means comprises a rocker having an intermediate point pivotally connected to said carriage assembly.

7. The invention as set forth in claim 1, wherein:

a) said connected means comprises a driver driven by the motor, and a link connected at one end to the driver, said link having its other end connected to said carriage assembly.

8. The invention as set forth in claim 7, wherein:

a) the driver further comprises a strut having spaced apart legs that straddle and connect to said one end of the link.

9. The invention as set forth in claim 1, wherein:

a) said panel is movable by said carriage assembly, with respect to said passageway, from said blocking position overlying the passageway, to its access position nested against the frame, and wherein b) substantially all portions of the panel lie within the confines of the frame when the panel is in its access position, so as not to interfere with pedestrians moving through said passageway.

10. The invention as set forth claim 1, wherein:

a) said frame includes guide disposed below the rail support, and adjacent that part of the frame near one of the floor of a lobby, room and pavilion; and b) said carriage assembly further having a roller slidable along said guide as the carriage assembly moves, to stabilize the panel's movement.

11. A barrier mechanism for providing selective access to a passageway on one of the floor of a lobby, room and pavilion, by a pedestrian, said barrier mechanism comprising in combination:

a) a frame, b) said frame including a rail support extending substantially parallel to the passageway, c) a carriage assembly slidably moveable on the rail support, d) a panel pivotally mounted to said carriage assembly, said panel being movable between opposed angular positions selectively blocking said passageway or providing access to said passageway, e) a reversible motor, f) means including a driver connected between said motor and said carriage assembly, to initiate and complete the sliding movement of the carriage assembly and panel along the rail support, as the motor is energized, g) said means further comprising a link, said link being driveable by said driver to opposite dispositions, one of which locks both said carriage assembly and said panel against movement out of the blocking position of said panel, and said driver and link further permitting limited yielding of the panel if the panel contacted or otherwise bumped by said pedestrian while the panel is in a position intermediate its blocking and its access position.

12. The invention as set forth in claim 11, wherein:

a) said driver and said link are part of an over-the-center mechanism which effects said locking of the carriage assembly and panel.

13. The invention as set forth in claim 11, wherein:

a) in said means, in another of said opposite dispositions both said carriage assembly said panel are locked against movement out of said access position of the panel.

14. A barrier mechanism for providing selective access to a passageway on one of the floor of a lobby, room and pavilion, by a pedestrian, said barrier mechanism comprising in combination:

a) a frame, b) said frame including a rail supporting extending substantially parallel to the passageway, c) a carriage assembly slidably moveable on the rail support, d) a panel pivotally mounted to said carriage assembly, said panel being movable between opposed angular positions selectively blocking said passageway or providing access to said passageway, e) a reversible motor, f) means including a driver connected between said motor and said carriage assembly, to initiate and complete the sliding movement of the carriage assembly and panel along the rail support, as the motor is energized, g) said means further comprising a link, said link being driveable by said driver to opposite dispositions, so as to lock both said carriage assembly and said panel against movement, either out of the blocking position or movement out of the access position of said panel, and further including h) means for sensing the approach of a pedestrian, and in response thereto, for automatically operating said motor in a direction to drive the panel to either its blocking position or its access position and to lock it therein, in accordance with a predetermined safety code prevailing in one of the floor of a lobby, room and pavilion.

* * * * *